US012636562B2

(12) United States Patent
Camper

(10) Patent No.: US 12,636,562 B2
(45) Date of Patent: May 26, 2026

(54) RODEO TRAINING DEVICE

(71) Applicant: Nate Camper, Genoa, OH (US)

(72) Inventor: Nate Camper, Genoa, OH (US)

( * ) Notice: Subject to any disclaimer, the term of this patent is extended or adjusted under 35 U.S.C. 154(b) by 682 days.

(21) Appl. No.: 18/085,802

(22) Filed: Dec. 21, 2022

(65) Prior Publication Data

US 2023/0211222 A1 Jul. 6, 2023

Related U.S. Application Data

(60) Provisional application No. 63/294,888, filed on Dec. 30, 2021.

(51) Int. Cl.
*A63B 69/00* (2006.01)
*A63B 69/04* (2006.01)

(52) U.S. Cl.
CPC ..... *A63B 69/0068* (2013.01); *A63B 69/04* (2013.01)

(58) Field of Classification Search
None
See application file for complete search history.

(56) References Cited

U.S. PATENT DOCUMENTS 1,489,701 A * 4/1924 Geiser ..... A63G 25/00 180/2.1
2,922,649 A * 1/1960 Hawkins ..... A63G 19/20 472/97
3,751,828 A * 8/1973 Frame ..... A63B 69/04 434/247
4,498,676 A * 2/1985 Runner ..... A63B 69/0068 273/336
4,702,475 A * 10/1987 Elstein ..... A63B 69/0053 482/84
4,713,010 A * 12/1987 Veillas ..... A63B 69/04 434/247
4,957,444 A * 9/1990 Armen ..... G09B 19/00 472/99
4,960,076 A * 10/1990 Snorgrass ..... A01K 15/02 273/368
4,988,300 A * 1/1991 Yamaguchi ..... A63B 69/04 472/99
5,080,373 A * 1/1992 Jones ..... A63B 69/0068 273/338
5,816,578 A * 10/1998 Frankamp ..... A63F 9/30 273/367
6,210,167 B1 * 4/2001 Nishiyama ..... A63F 13/214 446/29
6,422,945 B1 * 7/2002 Okita ..... A63F 13/245 463/8
7,175,440 B1 * 2/2007 Bateman ..... G09B 9/00 434/247
7,749,088 B2 * 7/2010 Greenwood ..... A63G 19/20 434/247

(Continued)

FOREIGN PATENT DOCUMENTS

KR 20140114659 A * 9/2014 ..... A63B 22/18

*Primary Examiner* — Xuan M Thai
*Assistant Examiner* — Andrew Bodendorf
(74) *Attorney, Agent, or Firm* — MacMillan, Sobanski & Todd, LLC

(57) ABSTRACT

A rodeo training device for the testing and improving of reaction speeds in rodeo events, an application for testing and improving reaction speeds, and methods for testing and improving reaction speeds, are described.

18 Claims, 4 Drawing Sheets

(56) References Cited

U.S. PATENT DOCUMENTS

| | | | | |
|---|---|---|---|---|
| 8,297,980 | B2 * | 10/2012 | Reynolds | G09B 19/003 273/338 |
| 9,129,534 | B2 * | 9/2015 | Payne | A63B 71/0622 |
| 10,888,760 | B1 * | 1/2021 | Cady | A63B 71/0686 |
| 2002/0014741 | A1 * | 2/2002 | Greenwood | G09B 19/0038 434/247 |
| 2006/0170163 | A1 * | 8/2006 | Perkins | A63B 69/0068 273/359 |
| 2009/0014960 | A1 * | 1/2009 | Brackens | A63B 69/0068 362/124 |
| 2015/0160620 | A1 * | 6/2015 | Gwynn, III | G04F 10/00 368/3 |
| 2018/0272238 | A1 * | 9/2018 | Cyr | A63H 17/38 |
| 2020/0360787 | A1 * | 11/2020 | Llewellyn | A63B 71/023 |

* cited by examiner

RODEO TRAINING DEVICE

RELATED APPLICATIONS

This application claims priority to U.S. Provisional Application No. 63/294,888, filed under 35 U.S.C. § 111(b) on Dec. 30, 2021, the entire disclosure of which is expressly incorporated herein by reference for all purposes.

BACKGROUND

There are challenges when training for rodeo events, in particular when seeking to improve reaction times and timing. For example, one desired improvement many individuals seek is to improve their reaction speed in letting go of a rope or the reins of a horse. However, conventional methods and devices for training for rodeo events are limited. Thus, there is a need in the art for new and improved methods and devices that facilitate training for rodeo events.

SUMMARY

Provided herein is a rodeo training device comprising a first dummy providing a representation of a horse; a second dummy in communication with the first dummy and providing a representation of a steer or other animal, wherein the second dummy comprises a series of steer indicator lights; reins on the first dummy in communication with a pressure switch configured to illuminate the series of steer indicator lights in a sequence and control a timer, wherein pressure applied through the reins causes the pressure switch to illuminate the series of steer indicator lights in the sequence and to start a timer, and releasing the pressure applied to the reins causes the pressure switch to stop the timer; and a steer position selector switch in communication with the selector switch, wherein the steer position selector switch is configured to select the sequence.

In certain embodiments, the series of steer indicator lights includes four steer indicator lights.

In certain embodiments, the series of steer indicator lights includes a plurality of steer indicator lights having a first color and one steer indicator light having a second color. In particular embodiments, the first color is yellow and the second color is green.

In certain embodiments, the first dummy is in wireless communication with the second dummy. In certain embodiments, the first dummy is in wired communication with the second dummy.

In certain embodiments, the series of steer indicator lights comprises lights on positions of the second dummy providing representations of two or more of a horn, head, neck, mid neck, full neck, point of shoulder, mid shoulder, 1st rib, 2nd rib, middle, flank, hip, and tail of the steer. In certain embodiments, the series of steer indicator lights comprises lights on positions of the second dummy providing representations of three or more of a horn, head, neck, mid neck, full neck, point of shoulder, mid shoulder, 1st rib, 2nd rib, middle, flank, hip, and tail of the steer. In certain embodiments, the series of steer indicator lights comprises lights on positions of the second dummy providing representations of four or more of a horn, head, neck, mid neck, full neck, point of shoulder, mid shoulder, 1st rib, 2nd rib, middle, flank, hip, and tail of the steer. In certain embodiments, the series of steer indicator lights comprises lights exclusively on a left side of the second dummy. In certain embodiments, the series of steer indicator lights comprises lights exclusively on a right side of the second dummy. In certain embodiments, the series of steer indicator lights comprises lights on both a left side of the second dummy and a right side of the second dummy.

In certain embodiments, the rodeo training device further comprises a horse indicator light on the first dummy in communication with the pressure switch, wherein the pressure switch is configured to illuminate the horse indicator light upon pressure being applied through the reins.

Further provided is a rodeo training device comprising a first dummy having reins and being in communication with a second dummy having a plurality of steer indicator lights, wherein pressure applied through the reins causes the plurality of steer indicator lights to illuminate in a sequence; and a timer in communication with the reins configured to measure an amount of time the pressure is applied through the reins.

In certain embodiments, the rodeo training device further comprises a selector switch configured to select a number of the plurality of steer indicator lights illuminated in the sequence. In particular embodiments, the selector switch is configured to select an amount of time between illumination of a first of the plurality of steer indicator lights and illumination of a second of the plurality of steer indicator lights in the sequence.

In certain embodiments, the rodeo training device further comprises a horse indicator light configured to illuminate while the pressure is applied through the reins.

Further provided is a method for testing reaction speeds using the rodeo training device described herein, the method comprising applying pressure through the reins to activate the pressure switch and cause illumination of the series of steer illuminator lights in the sequence; observing the illumination of the sequence of series of the steer illuminator lights until a preselected endpoint is reached; and releasing pressure from the reins so as to stop the timer.

In certain embodiments, the preselected endpoint comprises illumination of a green light in the series of steer indicator lights in the sequence.

Further provided is an application comprising a graphical user interface (GUI) displaying a button, wherein pressing and holding the button is configured to start a simulation depicting a steer leaving a chute with a series of lights on the steer becoming visible over a period of time; and a timer configured to measure an amount of time the button is held.

Further provided is a method for testing reaction speeds using the application, the method comprising pressing and holding the button on the graphical user interface (GUI); observing the depiction of the steer leaving the chute on the GUI; observing the series of lights become visible on the steer over the period of time; releasing the button at a preselected endpoint; and viewing the time measured by the timer. In certain embodiments, the preselected endpoint comprises observing a green light in the series of lights on the steer.

DETAILED DESCRIPTION

Throughout this disclosure, various publications, patents, and published patent specifications are referenced by an identifying citation. The disclosures of these publications, patents, and published patent specifications are hereby incorporated by reference into the present disclosure in their entirety to more fully describe the state of the art to which this invention pertains.

Provided herein is a rodeo training device configured to test and improve the reaction time of an individual training for a rodeo event. The rodeo training device may include a dummy horse that a user can mount their own saddle on, that may already include a saddle, and that may have a set of reins which run to a pressure switch inside of the mouth of the dummy horse. The rodeo training device may further include a dummy steer or calf next to or in front of the dummy horse, and having a series of lights connected to the electronic pressure switch on the dummy horse via a cord or wirelessly. A timer on the dummy horse, steer, or calf can measure the reaction time of a user using the rodeo training device, and display the measured time. Pressure being applied through the reins can activate a sequence of lights, such as a series of one, two, or three yellow lights followed by a green light on the dummy steer or calf, with the exact sequence being selected through a four-position selector switch. The lights can be made integrally with the dummy steer or calf or alternatively fastened to the dummy steer or calf in either a permanent or removable manner. The green light that can be placed on the dummy steer or calf can be in a location on the steer or calf where the user plans to visualize their "start" for a particular rodeo event. This location can be, for example, the horn, head, neck, mid neck, full neck, point of shoulder, mid shoulder, 1st rib, 2nd rib, middle, flank, hip, tail, or any other part of the steer or calf. As another example, this location can be the head, neck, back, and middle of the tail of the steer or calf. The lights can be placed wherever desired to replicate the start that the user would like to see so as to test and train the user's reaction time for starting the rodeo event. When the user sees the green light in the sequence of lights on the dummy steer or calf, the user can release the reins, which causes the timer to stop. This gives the user a measure of their reaction time and allows the user to sharpen their skills with practice. The rodeo training device can also be in the form of an arcade game, video game, or other game. An arcade game or video game may have the steer or calf on a screen rather than a physical embodiment. Also, the dummy horse and the calf or steer may have movement to give a more realistic experience in the arcade game or video game.

Figure 1:
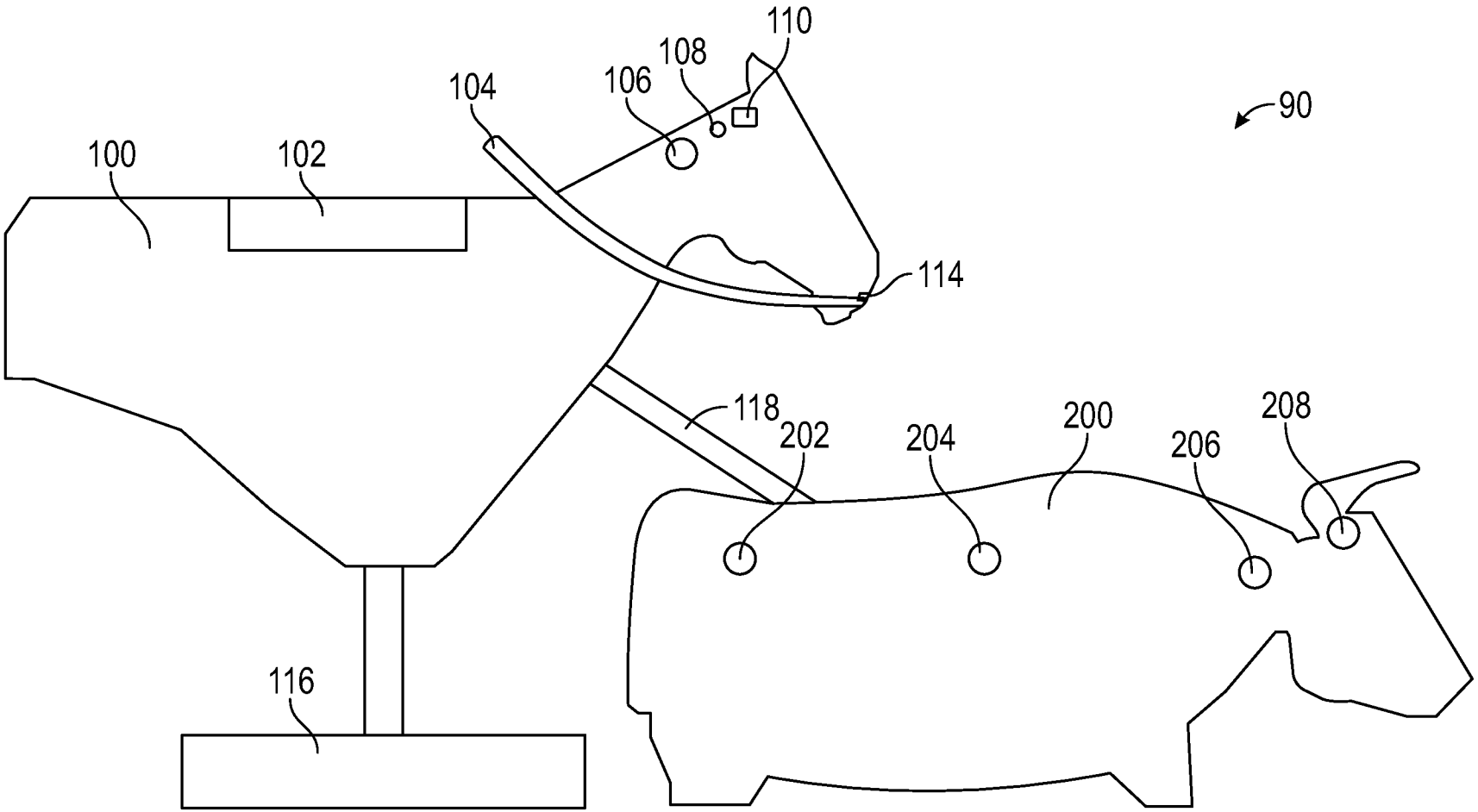
FIG. 1: Illustration of a non-limiting example embodiment of a rodeo training device.

Referring now to FIG. 1, an embodiment of a rodeo training device 90 is depicted. The rodeo training device 90 may include a first dummy 100 and a second dummy 200. The first dummy 100 may be a representation of a horse, and may therefore include a saddle 102 and reins 104, where an individual user may sit on the saddle 102 and hold the reins 104 to simulate sitting on a real horse. The first dummy 100 may include a suitable base 116 for support on the ground or surface. The base 116 may have any shape or configuration suitable for supporting the weight of the first dummy 100 with an individual sitting thereon. The first dummy 100 may further include a horse indicator light 108, a timer 110, a steer position selector switch 106, and a pressure switch 114, the purposes of which are described in more detail below.

Referring again to FIG. 1, the second dummy 200 may be a representation of a steer or other animal. The second dummy 200 may include a first steer indicator light 202, a second steer indicator light 204, a third steer indicator light 206, and a fourth steer indicator light 208, the purposes of which are described in more detail below.

Referring still to FIG. 1, the first dummy 100 and the second dummy 200 can be connected by a wire 118. However, this is not strictly necessary. Rather, the first dummy 100 and the second dummy 200 can be in wireless communication, such as through radio signals, Bluetooth, Wi-Fi, or by any other desired means. Furthermore, various elements such as the timer 110 and the steer position selector switch 106, though depicted in FIG. 1 as being located on the first dummy 100, may instead be located on the second dummy 200, on a remote controller, or any other desired location.

Referring still to FIG. 1, the first dummy 100 includes reins 104 that are connected to a pressure switch 114, or any other type of activating mechanism desired, so as to activate the pressure switch 114 when pressure is applied through the reins 104 (i.e., when a user pulls on or tightens the reins 104). The pressure switch 114 is in electrical communication with a horse indicator light 108 so as to illuminate the horse indicator light 108 when there has been pressure applied to the pressure switch 114 through the reins 104. When the pressure switch 114 is activated through the reins 104 (i.e., when pressure is applied to the reins 104), the rodeo training device 90 is configured to start the timer 110. When there is no longer pressure applied to the pressure switch 114 through the reins 104, the timer 110 is stopped. The timer 110 may include a display showing the measured time. The rodeo training device 90 may further include a storage device to save or record the reaction times obtained by the user. The saving of the reaction times can be done automatically or manually.

Referring still to FIG. 1, the second dummy 200 can be in the shape of a steer or calf. The second dummy 200 may include a number of indicator lights including the first steer indicator light 202, the second steer indicator light 204, the third steer indicator light 206, and the fourth steer indicator light 208. However, the number of steer indicator lights 202, 204, 206, 208 is not particularly limited. In one non-limiting example embodiment, four steer indicator lights 202, 204, 206, 208 are included. The steer indicator lights 202, 204, 206, 208 may be built into the second dummy 200, or they may be attached by any suitable fasteners such as, but not limited to, Velcro, glue, or tape. The steer indicator lights 202, 204, 206, 208 can be positioned in any desired location on the second dummy 200. These positions can be, for example, but are not limited to, the horn, head, neck, mid neck, full neck, point of shoulder, mid shoulder, 1st rib, 2nd rib, middle, flank, hip, and tail of the steer represented by the second dummy 200. As another example, these positions can be the head, neck, back, and middle of the tail of the steer represented by the second dummy 200. The steer indicator lights 202, 204, 206, 208 may all be on the same side of the steer represented by the second dummy 200, such as the left side or right side, or may alternatively include some lights on the left side of the steer represented by the second dummy 200 and some lights on the right side of the steer represented by the second dummy 200. A user can determine where the steer indicator lights 202, 204, 206, 208 should be located as a matter of preference. When pressure is applied to the pressure switch 114 through the reins 104 and through the steer position selector switch 106, a number of the steer indicator lights 202, 204, 206, 208 can be illuminated in a desired sequence over time. The steer indicator lights 202, 204, 206, 208 can be, for example, either yellow or green, and the quantity of steer indicator lights 202, 204, 206, 208 can depend on the position of the steer position selector switch 106. In some embodiments, one of the steer indicator lights 202, 204, 206, 208 is a different color from the other of the steer indicator lights 202, 204, 206, 208, so as to indicate a preselected endpoint for when a user should release the pressure applied through the reins 104.

Referring still to FIG. 1, the steer position selector switch 106 is in communication with the pressure switch 114 and can be used to select a number of steer indicator lights 202, 204, 206, 208 on the second dummy 200 that will illuminate, or to select a sequence in which the steer indicator lights 202, 204, 206, 208 are illuminated, upon activation of the pressure switch 114 by pressure applied through the reins 104. Changing these settings can be done by an external device, a switch, or any other desired means. The sequence may refer to the order in which the steer indicator lights 202, 204, 206, 208 are illuminated upon activation of the pressure switch 114 by pressure applied through the reins 104, the number of steer indicator lights 202, 204, 206, 208 that are illuminated upon activation of the pressure switch 114 by pressure applied through the reins 104, and/or to the amount of time between each of the steer indicator lights 202, 204, 206, 208 being illuminated upon activation of the pressure switch 114 by pressure applied through the reins 104. The steer position selector switch 106 can be used to adjust the timing of the illumination of the steer indicator lights 202, 204, 206, 208 in the sequence, such that certain of the steer indicator lights 202, 204, 206, 208 take longer or shorter intervals of time before illuminating.

Referring still to FIG. 1, a method for testing reaction speeds using a rodeo training device 90 may include applying pressure on a pressure switch 114 by tightening the reins 104, observing the illumination of one or more steer indicator lights 202, 204, 206, 208, and releasing pressure from a pressure switch 114 by loosening the reins 104. The steer indicator lights 202, 204, 206, 208 may illuminate one at a time until one of the steer indicator lights 202, 204, 206, 208 turns green, or otherwise a preselected endpoint is reached, at which point the user can release the reins 104, causing the pressure switch 114 to be released. When the reins 104 are released, the timer 110 stops, leaving a reaction speed time on the timer 110. The user can then view the timer 110 to determine their reaction time.

Referring still to FIG. 1, a method for testing reaction speeds using a rodeo training device 90 can include setting a second dummy 200 next to or in front of a first dummy 100, applying pressure to the reins 104 so as to apply pressure to a pressure switch 114, observing a series of steer indicator lights 202, 204, 206, 208 on the second dummy 200, releasing the reins 104 when a green light appears in one of the steer indicator lights 202, 204, 206, 208 on the second dummy 200, or other preselected endpoint is reached, and viewing the timer 110.

Figure 2:
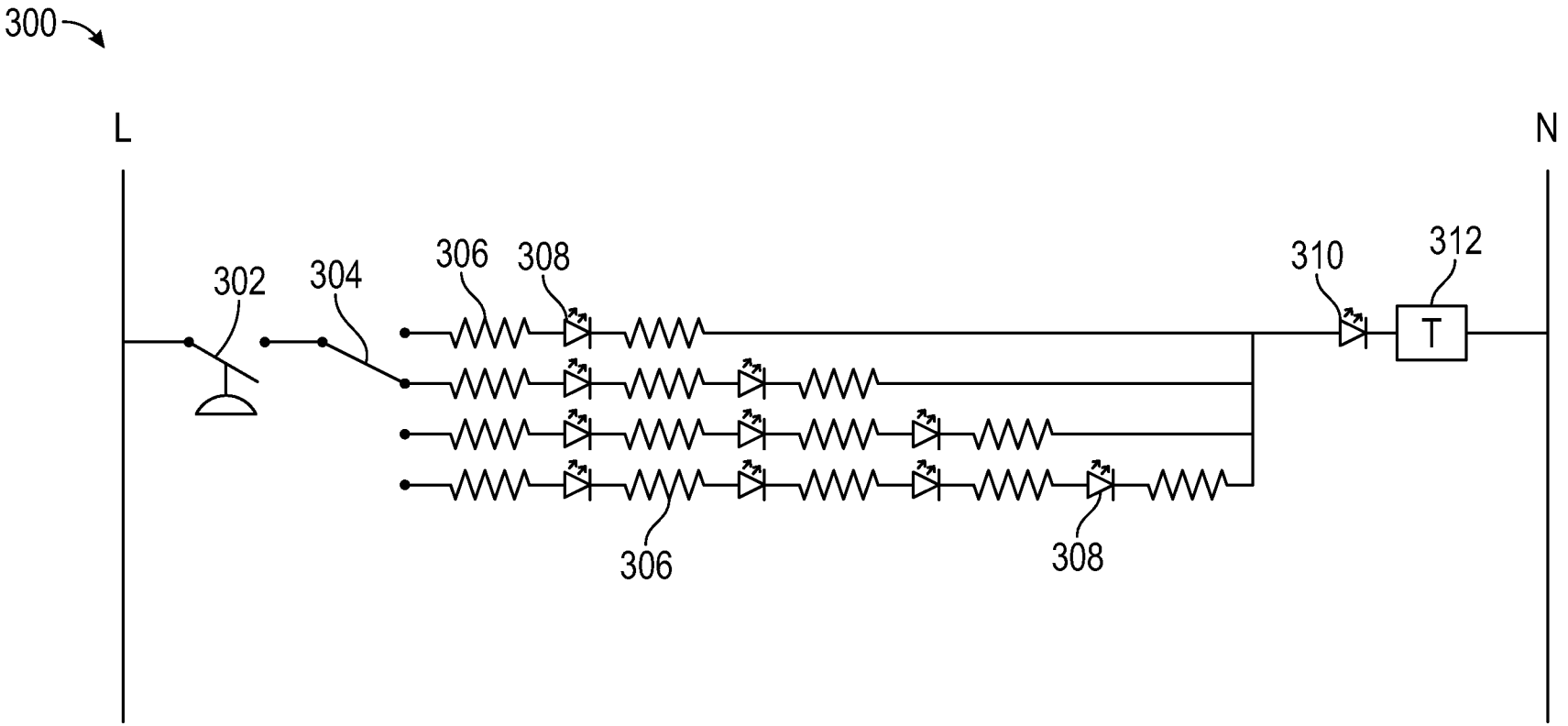
FIG. 2: Illustration of a non-limiting example of an electrical schematic of a rodeo training device.

Referring now to FIG. 2, a non-limiting example electrical schematic 300 for the rodeo training device 90 is depicted. The electrical schematic 300 is one possible way to obtain the desired connectivity and effects of the rodeo training device 90 described above, but other ways are possible and entirely encompassed within the scope of the present disclosure. The electrical schematic 300 includes a pressure switch 302 that is normally open in electrical communication with a position selector switch 304. The position selector switch 304 is in electrical communication with a series of resistors 306 and lights 308. There can be several series of resistors 306 and lights 308, and the position selector switch 304 can be used to select the desired number of lights 308 and timing. For example, the position selector switch 304 can select an electrical path that contains only two resistors 306 and one light 308. Alternatively, the position selector switch 304 can be moved in a different direction to select an electrical path that has five resistors 306 and four lights 308. The position selector switch 304 depicted in FIG. 2 is controlled by the steer position selector switch 106 depicted in FIG. 1, and the lights 308 depicted in FIG. 2 correspond to the steer indicator lights 202, 204, 206, 208.

Referring still to FIG. 2, the series of lights 308 and resistors 306 are in electrical communication with a green light 310, which is an indicating light having a color different from that of the lights 308. In this example, one of the steer indicator lights 202, 204, 206, 208 (corresponding to the endpoint of the sequence) is a different color (namely, green) from the others of the steer indicator lights 202, 204, 206, 208. The green light 310 is in electrical communication with a timer 312. While it is understood that this is just one possible way to wire the rodeo training device 90, the rodeo training device 90 may alternatively be wired using a series of logic gates and series of buttons in order to choose a desired effect of lights and timing.

Further provided herein is an application, such as an application for a smart phone or tablet, for testing and improving reaction speeds. The application can show a visual depiction or simulation of a steer leaving a chute, to simulate the start of a rodeo event. The application can also include a button that a user can press and hold with a left hand. Upon the user pressing and holding the button, after a short delay, a series of yellow lights illuminate down a series of points of the steer until a green light illuminates at the point on the steer that is chosen. The user can choose four different points, including for a short move, a horn, head, neck, mid neck, full neck, point of shoulder, mid shoulder, 1st rib, 2nd rib, middle, flank, hip, or tail of the steer. When the green light illuminates, the user releases the button. A red light and a negative reaction time result if the button is released too early. The user can also choose between a fast or slow leaving steer. The application can depict the steer going through the gate and yellow lights can illuminate at different points on the steer until the point the user chooses goes around the gate of the chute.

Figure 3:
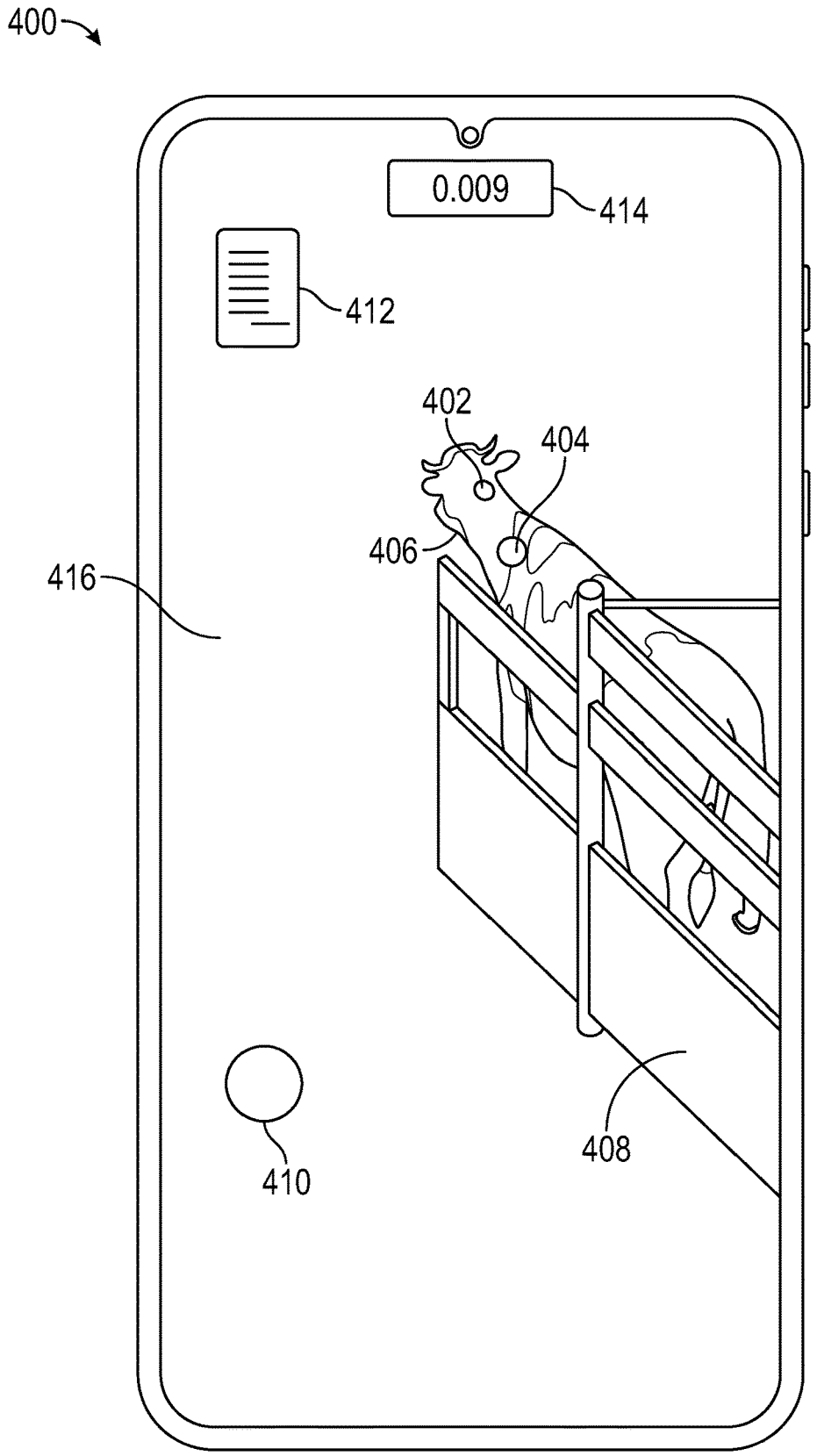
FIG. 3: Illustration of a non-limiting example embodiment of a reaction testing application.

Referring now to FIG. 3, a first example of the application 400 is depicted. The application 400 shows a graphical user interface (GUI) 416 which depicts a steer 406 or other animal, a chute 408, and a series of lights which can include a first light 404 and a second light 402. The number and colors of lights is not particularly limited. The first light 404 can be yellow, for example, and the second light can be green. The GUI 416 can also include a timer 414 and a button 410. The button 410 can be pressed to start the timer 414, and when the desired light (chosen from the first light 404 and the second light 402, in this example) becomes visible, the user can release the button 410 to receive a reaction time displayed on the timer 414. There may also be a menu 412 that can allow the user to customize the interaction of the application 400. For example, the user can adjust the number of lights on the steer 406 or the positioning of the lights on the steer 406 for a desired purpose. The user can also choose the speed at which the first light 404 and the second light 402 become visible as the depicted steer 406 leaves the chute 408, to make the application 400 more or less challenging.

Figure 4:
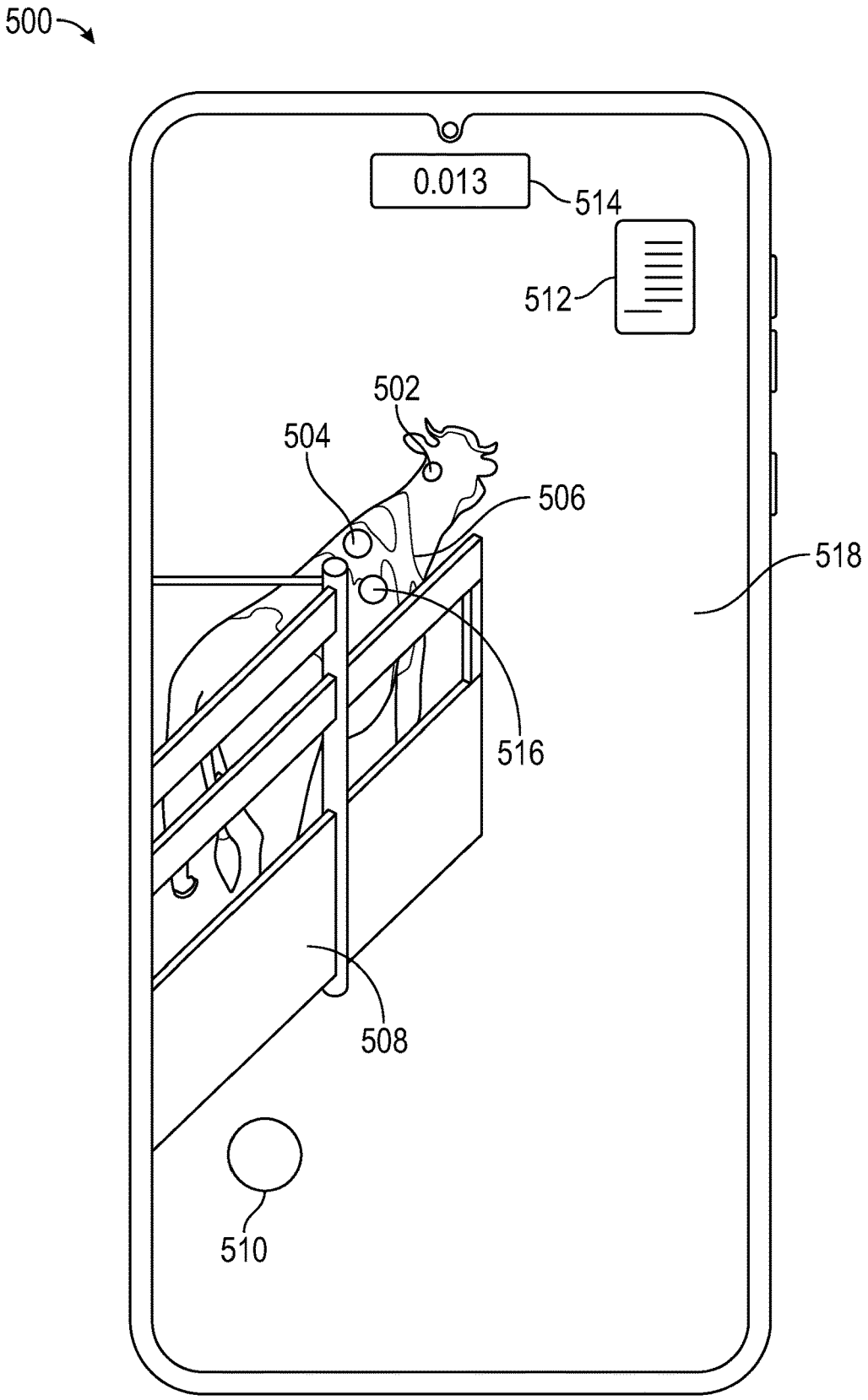
FIG. 4: Illustration of another non-limiting example embodiment of a reaction testing application.

Referring now to FIG. 4, a second example of the application 500 is depicted. The application 500 is the same as the application 400 depicted in FIG. 3, except the steer 506 and chute 508 are now positioned on the opposite side of the GUI 518 to allow a different approach to training. This does not have to be a separate application. Instead, there can be an option in the menu 512 to switch the position of the steer 506. In this example, the steer 506 has three lights, namely, a first light 516, a second light 504, and a third light 502, on it. Activation can begin once the button 510 is pushed and held, and the timer 514 can stop when the button 510 is released, causing the measured time to be displayed on the GUI 518.

Referring to FIGS. 3-4, a method for testing a user's reaction speed using the application 400, 500 may include pressing a button 410, 510, viewing a simulation of a steer 406, 506 leaving a chute 408, 508 on the GUI 416, 518, observing a series of lights on the steer 406, 506 on the GUI 416, 518, releasing the button 410, 510 when a green light on steer 406, 506 in the simulation depicted on the GUI 416, 518 becomes visible, and viewing the time measured by the timer 414, 514 depicted on the GUI 416, 518 to determine the user's reaction speed. The application 400, 500 and method are useful for training a user for rodeo events.

Certain embodiments of the systems, devices, methods, and applications disclosed herein are defined in the above examples. It should be understood that these examples, while indicating particular embodiments of the invention, are given by way of illustration only. From the above discussion and these examples, one skilled in the art can ascertain the essential characteristics of this disclosure, and without departing from the spirit and scope thereof, can make various changes and modifications to adapt the systems, devices, methods, and applications described herein to various usages and conditions. Various changes may be made, and equivalents may be substituted for elements thereof without departing from the essential scope of the disclosure. In addition, many modifications may be made to adapt a particular situation or material to the teachings of the disclosure without departing from the essential scope thereof.

What is claimed is:

1. A rodeo training device comprising:

a first dummy providing a representation of a horse;

a second dummy in communication with the first dummy and providing a representation of a steer or other animal, wherein the second dummy comprises a series of steer indicator lights;

reins on the first dummy in communication with a pressure switch configured to illuminate the series of steer indicator lights in a sequence and control a timer, wherein pressure applied through the reins causes the pressure switch to illuminate a set number of the series of steer indicator lights in the sequence and to start a timer, and releasing the pressure applied to the reins causes the pressure switch to stop the timer; and a steer position selector switch in communication with the pressure switch, wherein the steer position selector switch is configured to select the sequence.

2. The rodeo training device of claim 1, wherein the series of steer indicator lights includes four steer indicator lights.

3. The rodeo training device of claim 1, wherein the series of steer indicator lights includes a plurality of steer indicator lights having a first color and one steer indicator light having a second color.

4. The rodeo training device of claim 3, wherein the first color is yellow and the second color is green.

5. The rodeo training device of claim 1, wherein the first dummy is in wireless communication with the second dummy.

6. The rodeo training device of claim 1, wherein the first dummy is in wired communication with the second dummy.

7. The rodeo training device of claim 1, wherein the series of steer indicator lights comprises lights on positions of the second dummy providing representations of two or more of a horn, head, neck, mid neck, full neck, point of shoulder, mid shoulder, 1st rib, 2nd rib, middle flank, hip, or tail of the steer.

8. The rodeo training device of claim 1, wherein the series of steer indicator lights comprises lights on positions of the second dummy providing representations of three or more of a horn, head, neck, mid neck, full neck, point of shoulder mid shoulder, 1st rib, 2nd rib, middle, flank, hip, or tail of the steer.

9. The rodeo training device of claim 1, wherein the series of steer indicator lights comprises lights on positions of the second dummy providing representations of four or more of a horn, a head, neck, mid neck, full neck, point of shoulder, mid shoulder, 1st rib, 2nd rib, middle, flank, hip, or tail of the steer.

10. The rodeo training device of claim 1, further comprising a horse indicator light on the first dummy in communication with the pressure switch, wherein the pressure switch is configured to illuminate the horse indicator light while pressure is applied through the reins.

11. The rodeo training device of claim 1, wherein the steer indicator lights comprise lights exclusively on a left side of the second dummy from the perspective of a user on the first dummy.

12. The rodeo training device of claim 1, wherein the steer indicator lights comprise lights exclusively on a right side of the second dummy from the perspective of a user on the first dummy.

13. The rodeo training device of claim 1, wherein the steer indicator lights comprise lights on both a left side of the second dummy and a right side of the second dummy from the perspective of a user on the first dummy.

14. A method for testing reaction speeds using the rodeo training device of claim 1, the method comprising:

applying pressure through the reins to activate the pressure switch and cause illumination of the series of steer illuminator lights in the sequence;

observing the illumination of the series of steer illuminator lights in the sequence until a preselected endpoint is reached; and releasing pressure from the reins so as to stop the timer.

15. A rodeo training device comprising:

a first dummy having reins in communication with a pressure switch and being in communication with a second dummy having a plurality of steer indicator lights, wherein pressure applied through the reins causes the plurality of steer indicator lights to illuminate in a sequence;

a timer in communication with the reins configured to measure an amount of time the pressure is applied through the reins; and a steer position selector switch in communication with the pressure switch, wherein the steer position selector switch is configured to select the sequence.

16. The rodeo training device of claim 15, wherein the steer position selector switch is configured to select a number of the plurality of steer indicator lights illuminated in the sequence.

17. The rodeo training device of claim 16, wherein the steer position selector switch is configured to select an amount of time between illumination of a first of the plurality of steer indicator lights and illumination of a second of the plurality of steer indicator lights in the sequence.

18. The rodeo training device of claim 15, further comprising a horse indicator light configured to illuminate while the pressure is applied through the reins.

* * * * *